US012311221B1

(12) United States Patent
Mikulski

(10) Patent No.: US 12,311,221 B1
(45) Date of Patent: May 27, 2025

(54) STRADDLE DOOR MOUNT TRAVEL GYM SYSTEM

(71) Applicant: Walter J. Mikulski, Orlando, FL (US)

(72) Inventor: Walter J. Mikulski, Orlando, FL (US)

( * ) Notice: Subject to any disclaimer, the term of this patent is extended or adjusted under 35 U.S.C. 154(b) by 0 days.

(21) Appl. No.: 18/978,399

(22) Filed: Dec. 12, 2024

(51) Int. Cl.

| | |
|---|---|
| ***A63B 21/16*** | (2006.01) |
| ***A63B 21/04*** | (2006.01) |
| ***A63B 21/055*** | (2006.01) |
| ***A63B 23/035*** | (2006.01) |
| ***A63B 23/12*** | (2006.01) |
| ***A63B 71/00*** | (2006.01) |

(52) U.S. Cl.
CPC ..... *A63B 21/1645* (2013.01); *A63B 21/0442* (2013.01); *A63B 21/0555* (2013.01); *A63B 21/0557* (2013.01); *A63B 23/03541* (2013.01); *A63B 23/1209* (2013.01); *A63B 71/0054* (2013.01)

(58) Field of Classification Search
CPC ..... A63B 21/1645; A63B 21/0442; A63B 21/0555; A63B 21/0557; A63B 23/03541; A63B 23/1209; A63B 71/0054
See application file for complete search history.

(56) References Cited

U.S. PATENT DOCUMENTS 3,695,256 A * 10/1972 Brower ..... A63B 21/1663 248/231.41
4,328,964 A * 5/1982 Walls ..... A63B 21/0552 482/129
4,909,505 A * 3/1990 Tee ..... A63B 21/0552 482/121
5,163,889 A * 11/1992 Kaaua ..... A63B 21/1654 482/904
5,186,698 A * 2/1993 Mason ..... A63B 21/0552 482/121
5,209,482 A * 5/1993 Hopfer ..... A63B 69/0059 482/904
5,277,683 A * 1/1994 Wilkins ..... A63B 21/0552 482/121
5,342,274 A * 8/1994 Hunker ..... A63B 23/0211 482/904
5,571,064 A * 11/1996 Holm ..... A63B 21/4043 482/904
6,908,418 B2 * 6/2005 Saure ..... A63B 21/0552 482/904
9,248,331 B1 * 2/2016 Collier ..... A63B 21/4035
12,201,866 B2 * 1/2025 Evans ..... A63B 21/1645
2004/0087420 A1 * 5/2004 Montesquieux ... A63B 21/0552 482/121
2005/0070406 A1 * 3/2005 Delp ..... A63B 23/0211 482/91

(Continued)

*Primary Examiner* — Andrew S Lo
(74) *Attorney, Agent, or Firm* — Jason T. Daniel, Esq.; Daniel Law Offices, P.A.

(57) ABSTRACT

An exercise system includes a door stop and a door sleeve having an elongated sleeve body with a U-shaped channel along the bottom surface. The door sleeve is positioned along the top wall of a door with the sides of the sleeve straddling the top wall. A security anchor connects the back of the door sleeve to the back of the door via an adjustable length tether. A resistance cable device is provided and includes an elastic band having handles along each end. The band is positioned across the top of the door sleeve and is retained in place by a pair of cable stops extending upward from the top surface of the door sleeve.

8 Claims, 6 Drawing Sheets

(56) References Cited

U.S. PATENT DOCUMENTS

| | | | | |
|---|---|---|---|---|
| 2007/0207904 | A1* | 9/2007 | Wu | A63B 21/0004 482/126 |
| 2010/0173759 | A1* | 7/2010 | Lalaoua | A63B 21/4005 482/121 |
| 2011/0195825 | A1* | 8/2011 | Liester | A63B 21/4043 482/120 |
| 2013/0157821 | A1* | 6/2013 | Crowell | A63B 21/4034 482/129 |
| 2013/0190148 | A1* | 7/2013 | Allison | A63B 21/0442 482/129 |
| 2013/0196831 | A1* | 8/2013 | Kinsbourne | A63B 21/4043 482/92 |
| 2014/0256514 | A1* | 9/2014 | Garner | A63B 21/055 482/91 |
| 2015/0031512 | A1* | 1/2015 | Schleiden, II | A63B 21/0442 482/139 |
| 2015/0141217 | A1* | 5/2015 | Young | A63B 21/4031 482/126 |
| 2017/0028245 | A1* | 2/2017 | Williams | A63B 21/4019 |
| 2017/0087435 | A1* | 3/2017 | Jones | A63B 71/0622 |
| 2018/0318631 | A1* | 11/2018 | Siu | A63B 21/0442 |
| 2018/0353833 | A1* | 12/2018 | Croft | A63B 21/1645 |
| 2019/0352951 | A1* | 11/2019 | Howson | E05D 5/128 |
| 2020/0206560 | A1* | 7/2020 | Alexandru | A63B 21/1681 |
| 2020/0261758 | A1* | 8/2020 | Souffrain | A63B 21/4017 |
| 2022/0193484 | A1* | 6/2022 | Bartley | A63B 21/4035 |
| 2023/0110715 | A1* | 4/2023 | David | A63B 21/0557 482/121 |

* cited by examiner

STRADDLE DOOR MOUNT TRAVEL GYM SYSTEM

TECHNICAL FIELD

The present invention relates generally to the fitness industry, and more particularly to a travel gym system that mounts to a door in a straddle configuration.

BACKGROUND

The statements in this section merely provide background information related to the present disclosure and may not constitute prior art.

Physical fitness is an important element in maintaining a healthy body. However, many people do not regularly visit a gym because they simply don't have time or won't make the time. As such, there are many different types of home gym exercise equipment, but such devices are quite large and cumbersome, such that a user is forced to devote an inordinate amount of space, which is particularly inconvenient for home use by an average person.

An alternative to traditional exercise equipment has recently emerged in the form of resistance training. In this regard, there are known systems which engage a closed door to allow a user to conduct resistance training. However, such systems are problematic as the force imparted onto the door through the exercise process is tortional and has a tendency to bend/warp the door itself. Moreover, it is not uncommon for these devices to bend or otherwise break the door latch causing the door to suddenly open which can cause injury to the user undergoing the exercise routine. Finally, such devices require a user to position themselves in a purely perpendicular orientation to the door frame, which may not be ideal for small rooms.

The present invention, directed to a straddle door mount exercise system differs from the conventional art in a number of aspects. The manner by which will become more apparent in the description which follows, particularly when read in conjunction with the accompanying drawings.

SUMMARY OF THE INVENTION

The present invention is directed to an exercise system. One embodiment of the present invention can include a door stop, a resistance cable device, a door sleeve, and a door sleeve anchor. In one embodiment, the door sleeve can include an elongated sleeve body having a generally U-shaped channel along the bottom surface. The door sleeve can be positioned along the top wall of a door in the open position via the channel with the sides of the sleeve straddling the top wall.

In one embodiment, the security anchor can include an elongated tether that is connected to the back end of the door sleeve. The ends of the tether can be connected together by a buckle, and the length of the tether is adjustable. The middle section of the tether can extend outward to engage the upper hinge of the door to secure the door sleeve onto the top of the door.

In one embodiment, the resistance cable device can include one or more elastic bands having handles along each end. The bands of the cable are positionable onto the top of the door sleeve and are retained in place by a pair of cable stops extending upward from the top surface of the door sleeve. A doorstop can be positioned beneath the door to prevent movement of the door during an exercise routine.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
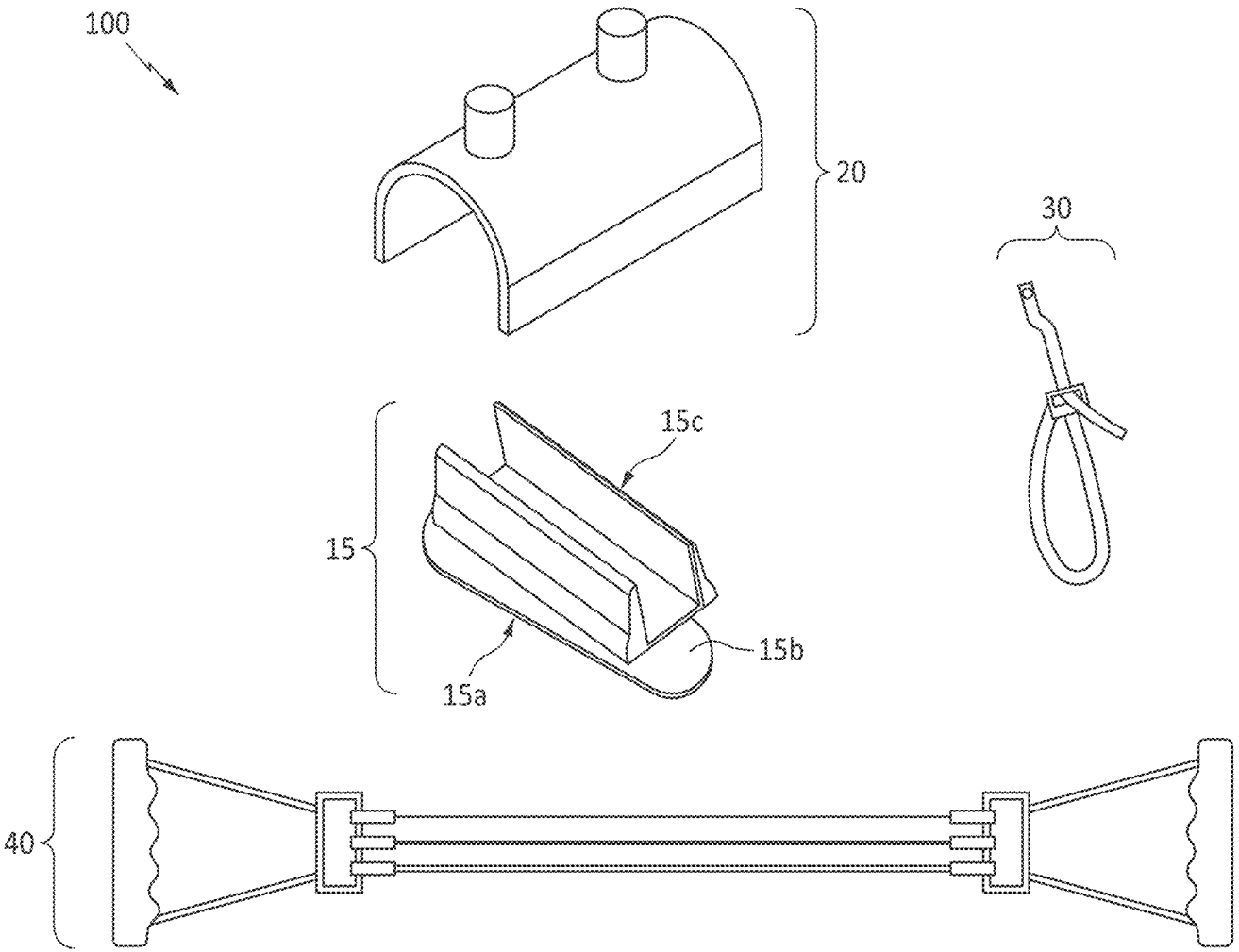
FIG. 1 is an exploded parts view of an exercise system in accordance with one embodiment of the invention.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Definitions

As described herein, a "unit" means a series of identified physical components which are linked together and/or function together to perform a specified function.

As described throughout this document, the term "about" "approximately" "substantially" and "generally" shall be used interchangeably to describe a feature, shape, or measurement of a component within a tolerance such as, for example, manufacturing tolerances, measurement tolerances or the like.

As described herein, the term "removably secured," and derivatives thereof shall be used to describe a situation wherein two or more objects are joined together in a non-permanent manner so as to allow the same objects to be repeatedly joined and separated.

As described throughout this document, the term "complementary shape," and "complementary dimension," shall be used to describe a shape and size of a component that is identical to, or substantially identical to the shape and size of another identified component within a tolerance such as, for example, manufacturing tolerances, measurement tolerances or the like.

As described herein, the term "connector" includes any number of different elements that work alone or together to repeatedly join two items together in a nonpermanent manner. Several nonlimiting examples of connectors include but are not limited to thread-to-connect, twist-to-connect, and push-to-connect type devices, opposing strips of hook and loop material (e.g., Velcro®), attractively oriented magnetic elements or magnetic and metallic elements, buckles, hooks, snaps and buttons, for example.

FIGS. 1-5B illustrate one embodiment of a straddle door mount exercise system 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 5A.

FIG. 1 illustrates an exploded parts view of one embodiment of the system 10 that is useful for understanding the inventive concepts disclosed herein. As shown, the system 10 can include a door stop 15, a door sleeve 20, a security anchor 30, and a resistance exercise cable device 40.

The door stop 15 can include a generally wedge-shaped base member 15*a* having an angled surface 15*b* onto which a U-shaped channel 15*c* is positioned. The Channel 15*c* can be permanently or removably secured onto the angled surface and can function to engage the bottom wall of a door as will be described below. The doorstop can be constructed from any number of high friction non-skid materials such as rubber or plastic, for example, and can function in two distinct manners. First, the door stop can prevent the door from moving along its hinges between an open and closed position during operation of the system. Second, the door stop can function to absorb the downward forces applied onto the door during use of the exercise system so as to remove the pulling forces that would otherwise be applied onto the door hinges. Such a feature advantageously removes damaging forces from the door and hinge assembly.

Although illustrated and described with regard to a wedge-shaped stop, this is for illustrative purposes only, as any number of other devices including commercially available door stops capable of immobilizing a type of door may be utilized herein.

Figure 2:
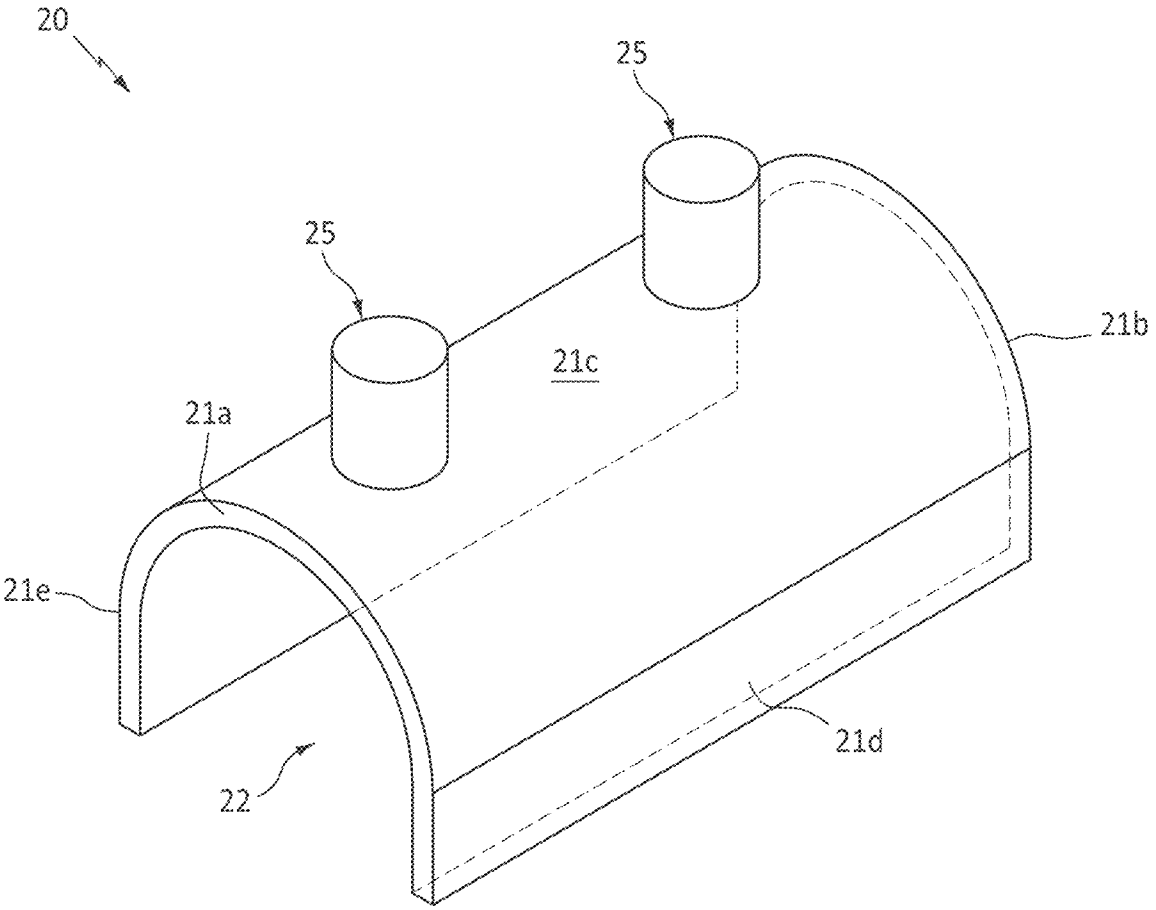
FIG. 2 is a perspective view of the door sleeve of the exercise system, in accordance with one embodiment of the invention.
Figure 3:
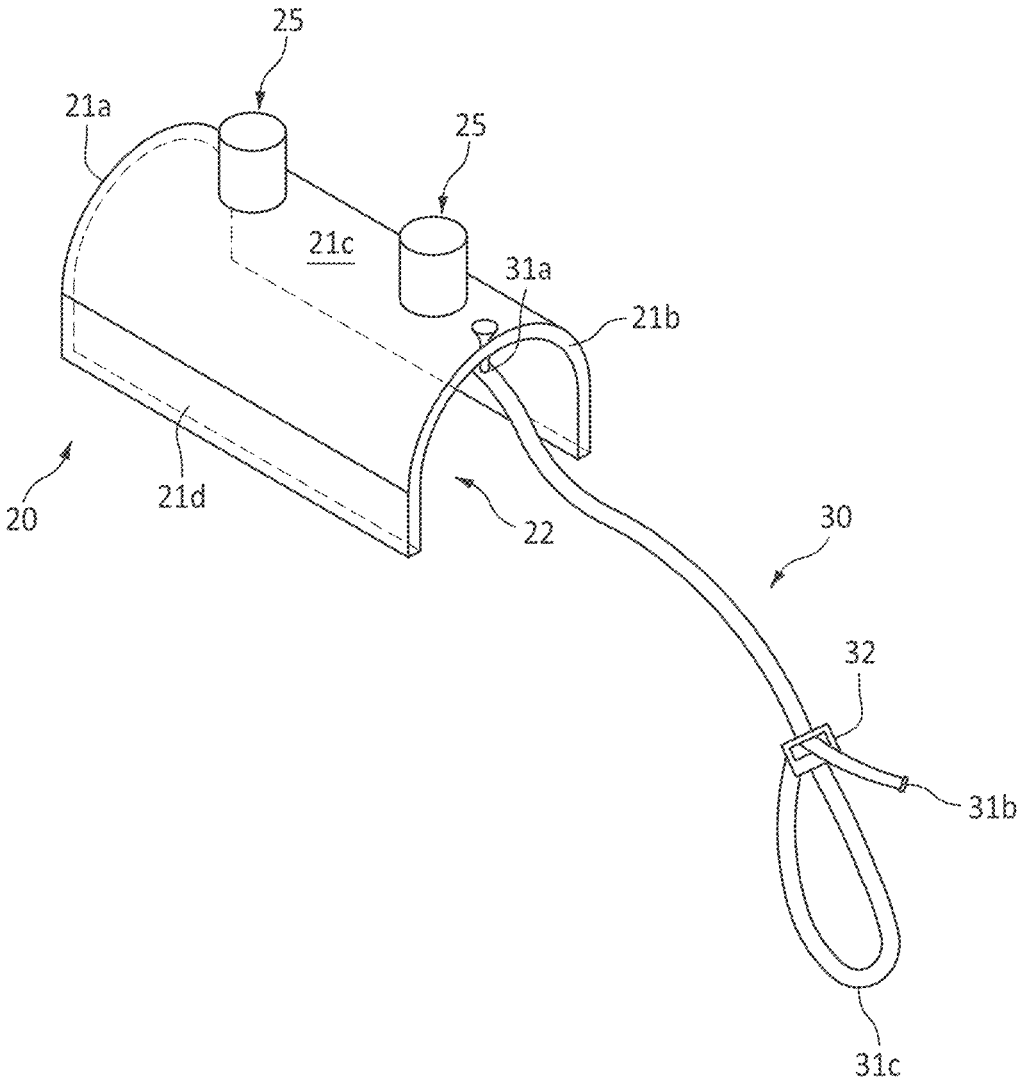
FIG. 3 is a perspective view of the door sleeve and security anchor of the exercise system, in accordance with one embodiment of the invention.

As shown best at FIG. 2, the door sleeve 20 can include an elongated member having a first end 21*a*, a second end 21*b*, a curved top surface 21*c* that terminates into a pair of side surfaces 21*d* and 21*e*. As shown, the bottom of the sleeve body can include a generally U-shaped channel 22 extending between the side surfaces from the first end to the second end of the member. As will be described below, the channel functions to allow the sleeve to be positioned along the top wall of a door such that the side surfaces of the sleeve straddle the front and back walls of the door.

As described herein, the door sleeve body can be formed from any number of different materials that are, for example, relatively strong for their weight. Several nonlimiting examples include but are not limited to various metals or metal alloys (e.g., aluminum, steel, titanium, or alloys thereof), various plastics and/or plastic polymers (e.g., high-density polyethylene (HDPE), rigid polyvinyl chloride (PVC)), and/or various composite materials (e.g., carbon fibers in a polymer matrix, fiberglass, etc.).

In either instance, it is important that the door sleeve body includes an ultimate tensile strength capable of sustaining forces in excess of 200 pounds, so as to allow users of all fitness levels to utilize the device for a variety of exercise routines without causing the body to stretch, twist or otherwise fail during use. Of course, any number of other materials and material properties are also contemplated.

In one embodiment, a pair of cable stops 25 can be positioned along the top surface 21*c* of the door sleeve. In the preferred embodiment, each of the cable stops 25 will include a height that is greater than the thickness of the below described resistance exercise cables 40 and will be positioned adjacent to the first and second ends of the sleeve body. In this regard, the cable stops can function to limit the lateral movement of the resistance cables 40 along the length of the sleeve body during operation of the system.

In one embodiment, each of the cable stops can include a generally tubular-shaped member that is constructed from, or lined with a high friction material such as rubber, for example. Such features advantageously allows the cable stops to grip the cable to preventing the same from sliding over the top of the cable stop and becoming separated from the sleeve body during operation of the system.

Although described above with regard to a particular shape, size, or material, this is for illustrative purposes only, as the cable stops may be positioned anywhere along the length of the sleeve body, and may include any number of different shapes, sizes, and/or construction materials.

The security anchor 30 can function to secure the sleeve 20 onto a door during operation of the system 10. As shown best at FIG. 3, the security anchor 30 can include an elongated tether having a first end 31*a*, a second end 31*b*, and a looped middle section 31*c*. In one embodiment, the first end of the tether is connected to the second end 21*b* of the sleeve 20, and a length adjusting mechanism 32 such as a slide buckle, for example, is provided to allow a user to adjust the length of the tether, so as to selectively increase or decrease the distance of the loop 31*c* relative to the sleeve body 20. As will be described below, the loop 31*c* can engage the back wall of a door to prevent the sleeve from moving during operation of the system. Of course, the tether may also be connected to other portions of the door or door components. In either instance, the tether can be constructed from any number of malleable and inelastic materials having a high-tension strength such as nylon webbing tether, for example.

Figure 4:
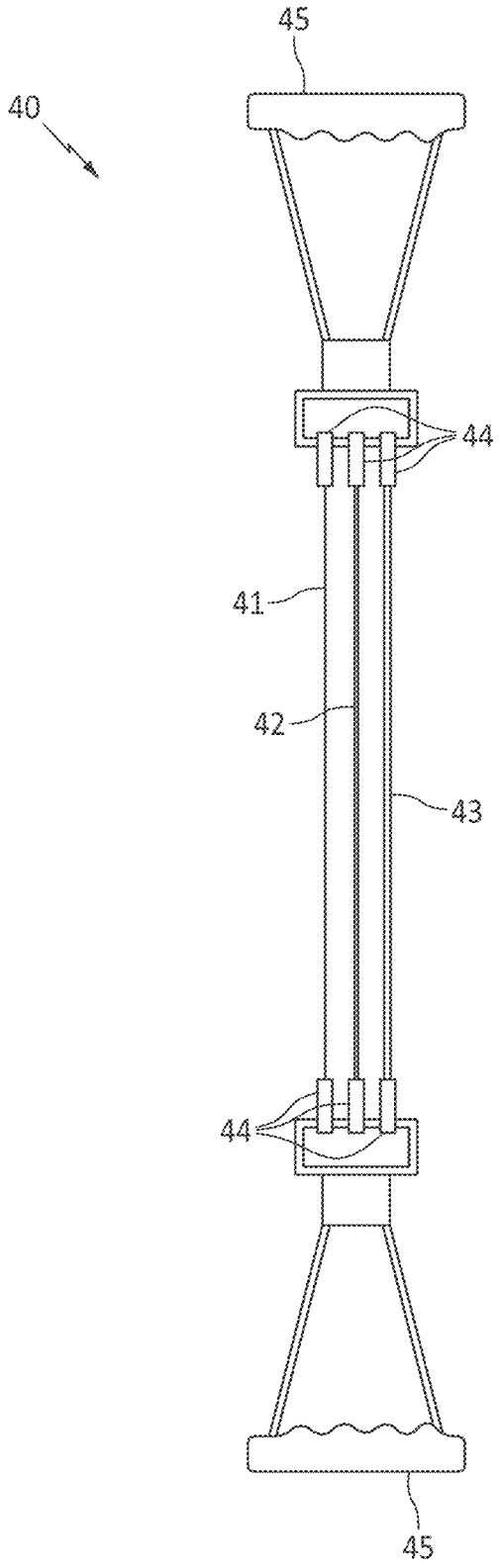
FIG. 4 is a front view of the resistance exercise cable of the exercise system, in accordance with one embodiment of the invention.

FIG. 4 illustrates one embodiment of a resistance exercise cable device 40 for use with the system. As shown, the device can include a plurality of individual bands that are individually connected to a pair of handles. As described herein, each band can be constructed from an elastomeric material having a known resistance to being stretched. For example, the exercise bands can include a first band 41 capable of imparting light resistance (e.g., 5-30 lbs), a second band 42 capable of imparting medium resistance (e.g., 20-50 lbs), and a third band 43 capable of imparting heavy resistance (e.g., 25-70 lbs). Each of the bands can include clips 44 or other such connectors along both ends for being individually or cumulatively connected to the handles 45 to allow the user to choose their resistance level during an exercise routine.

Although described with regard to three bands and a set resistance amount, this is for illustrative purposes only, as any number of bands may be utilized each having any number of different resistance levels.

Figure 5A:
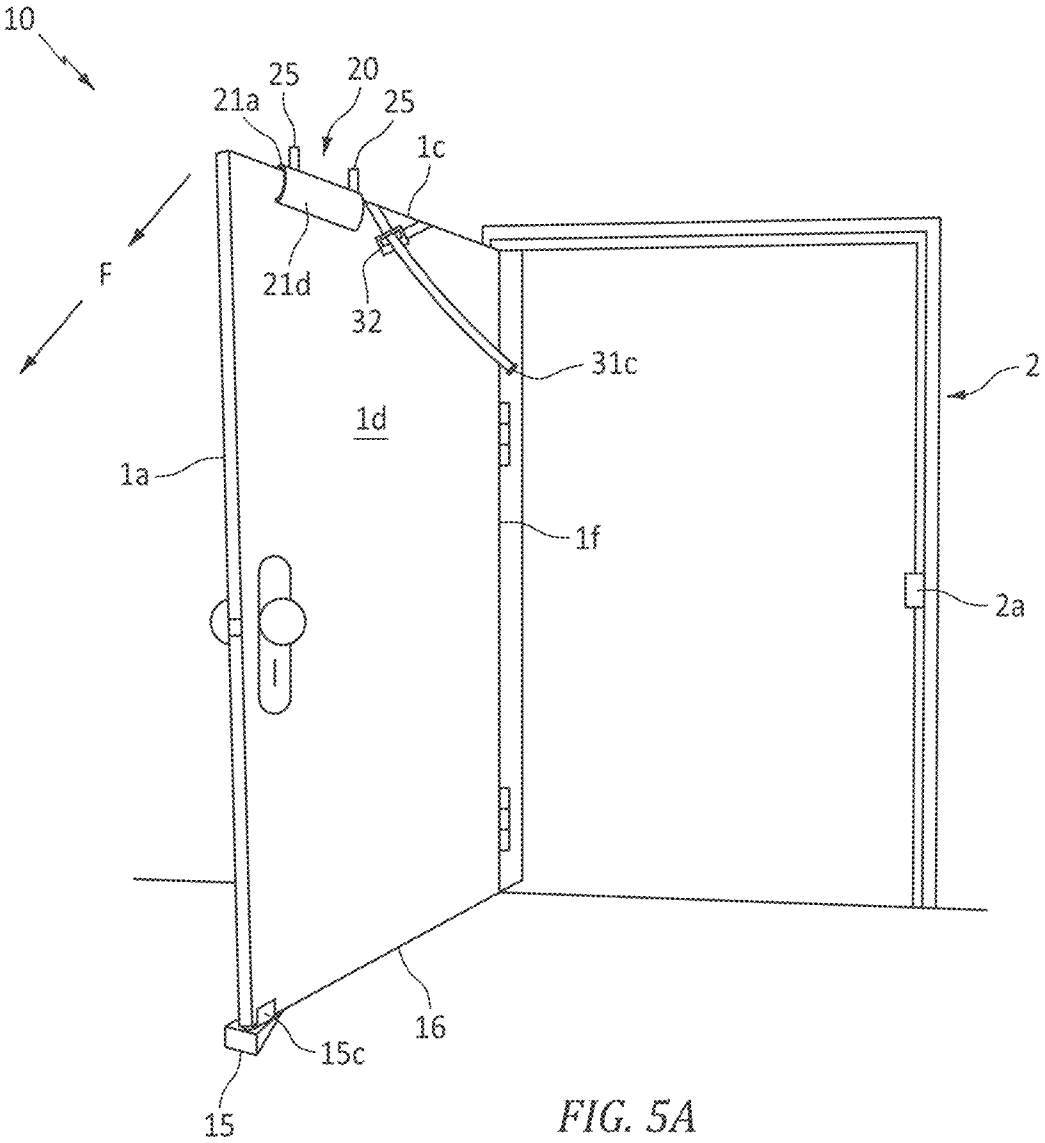
FIG. 5A is a perspective view of the exercise system in operation, in accordance with one embodiment of the invention.
Figure 5B:
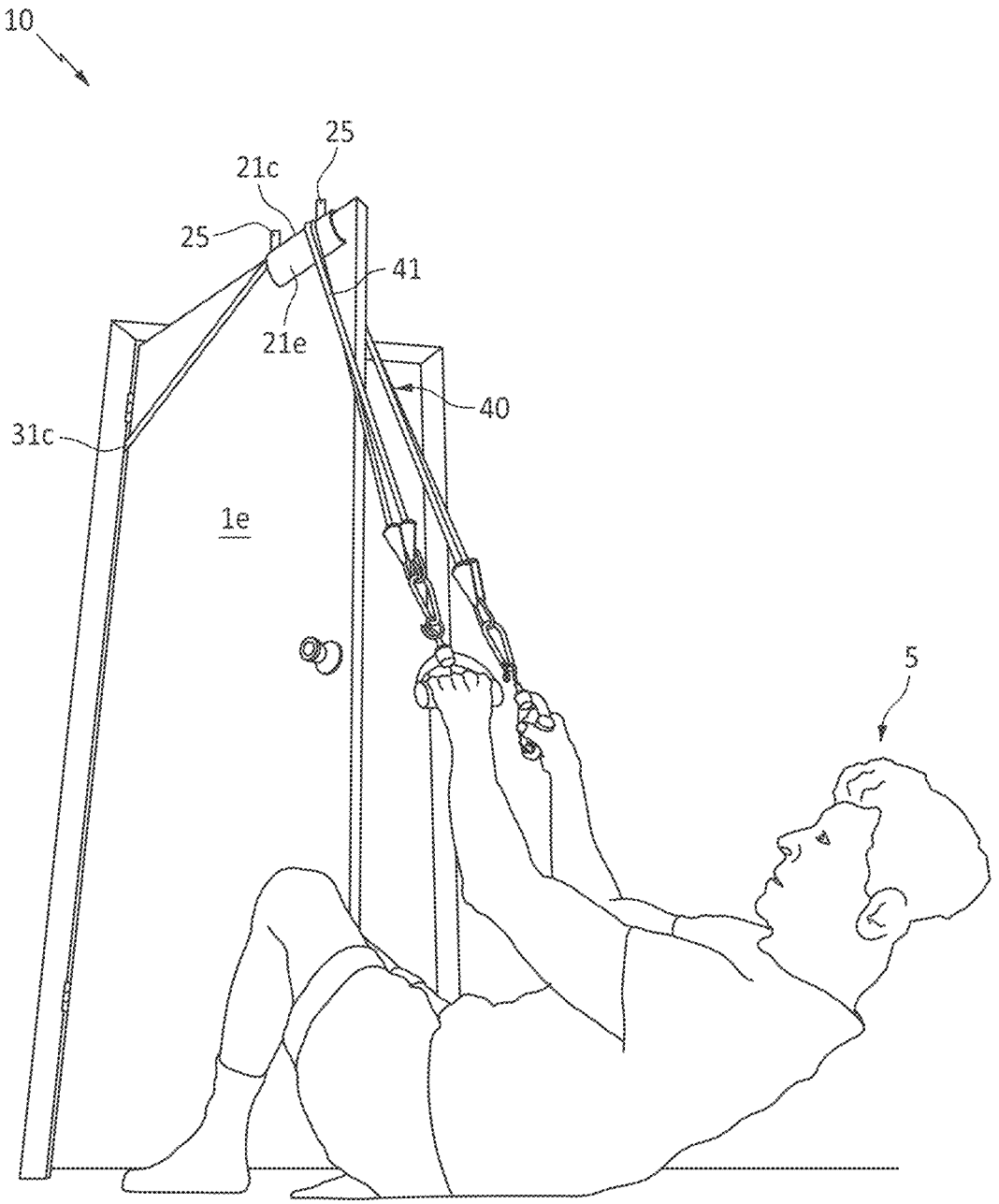
FIG. 5B is another perspective view of the exercise system in operation, in accordance with one embodiment of the invention.

FIGS. 5A and 5B illustrates one embodiment of the system 10 in operation with a door. As shown, the door can be positioned in any open configuration where the latch on the outside edge 1*a* of the door is not engaged with the catch 2*a* of the door frame 2. When in the desired position, the door stop 15 can be positioned beneath the bottom wall 1*b* of the door with the wall located within the U shaped channel 15*c* of the door stop to immobilize the door in the desired position throughout the exercise routine.

Next, the door sleeve 20 can be positioned onto the top wall 1*c* of the door such that the top wall is located within the sleeve channel with the side surfaces 21*d* and 21*e* straddling the top wall so as to engage the front and rear walls 1*d*, and 1*e* of the door, respectively. When so positioned, the loop 31*c* of the tether of the security anchor 30 can be positioned behind the inside wall If of the door, and the length of the tether can be adjusted via the buckle 32.

Finally, the band(s) 41 of the exercise cable device 40 can be positioned across the curved top surface 21*c* of the door sleeve and a user 5 can impart a pulling force onto the cable device. When utilized in this manner, the security anchor will immobilize the door sleeve, and the cable stop 25 will prevent the band(s) 41 of the exercise cable from sliding off of the sleeve as the user conducts any number of desired exercises.

Importantly, because the sleeve body straddles the top of the door, the force F imparted by the system onto the door 1 is directly in line with the width of the door (e.g., between inside and outside walls 1*a* and 1*f*) and is perpendicular to the same. Such a feature is critical, as this eliminates the tortional forces imparted on the front and back surfaces (e.g., 1*d* and 1*e*) of the door encountered with traditional devices, as described above and thus eliminates the damage and risk of injuries described. Moreover, the presence of the door stop beneath the door absorbs the forces and alleviates strain on the door hinges.

As to a further description of the manner and use of the present invention, the same should be apparent from the above description. Accordingly, no further discussion relating to the manner of usage and operation will be provided.

As described herein, one or more elements of the device 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the term "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. An exercise system, comprising:

a door sleeve having a front end, a back end, and a top surface;

a first cable stop that is positioned adjacent to the front end of the door sleeve;

a second cable stop that is positioned adjacent to the back end of the door sleeve;

a security anchor that is configured to engage the door sleeve; and a door stop device, wherein the door sleeve is configured to be positioned along a top wall of a door, the door stop is configured to engage a bottom wall of the door, and the security anchor is configured to secure the door sleeve to the door during an exercise routine.

2. The device of claim 1, wherein each of the first cable stop and the second cable stop are positioned along the top surface of the door sleeve.

3. The device of claim 2, wherein each of the first cable stop and the second cable stop includes a curved surface that is configured to engage a resistance exercise cable device.

4. The device of claim 1, wherein the security anchor includes an elongated tether having a middle section that extends outward from the door sleeve.

5. The device of claim 4, wherein the security anchor is connected to the back end of the door sleeve.

6. The device of claim 1, further comprising:

a resistance exercise cable that includes an elastic band that is connected to a pair of handles.

7. The device of claim 1, further comprising:

a resistance exercise cable that includes a plurality of elastic bands that are connected to a pair of handles.

8. The device of claim 1, wherein the door sleeve includes an ultimate tensile strength of at least 200 pounds.

* * * * *